US005644928A

United States Patent [19]

Uda et al.

[11] Patent Number: 5,644,928

[45] Date of Patent: Jul. 8, 1997

[54] AIR REFRIGERANT ICE FORMING EQUIPMENT

[75] Inventors: Motohisa Uda; Isao Nikai, both of Yokohama; Junji Matsuda, Narashino, all of Japan

[73] Assignee: Kajima Corporation, Tokyo, Japan

[21] Appl. No.: 724,872

[22] Filed: Oct. 3, 1996

Related U.S. Application Data

[63] Continuation of Ser. No. 428,128, filed as PCT/JP93/00316, Mar. 17, 1993, abandoned.

[30] Foreign Application Priority Data

Oct. 30, 1992 [JP] Japan ..... 4-314372

[51] Int. Cl.[6] ..... F25B 9/00

[52] U.S. Cl. ..... 62/402; 62/87

[58] Field of Search ..... 62/86, 87, 401, 62/402

[56] References Cited

U.S. PATENT DOCUMENTS

| | | | |
|---|---|---|---|
| 2,777,301 | 1/1957 | Kuhn | 62/402 X |
| 2,805,268 | 9/1957 | Cunningham | 62/402 X |
| 4,109,486 | 8/1978 | Sieck | 62/402 |
| 4,175,400 | 11/1979 | Edwards et al. | 62/174 |
| 4,262,495 | 4/1981 | Gupta et al. | 62/402 |
| 4,730,464 | 3/1988 | Lotz | 62/401 |
| 4,984,432 | 1/1991 | Corey | 62/402 X |

FOREIGN PATENT DOCUMENTS

| | | |
|---|---|---|
| 52-39579 | 10/1977 | Japan . |
| 59-52343 | 12/1984 | Japan . |
| 60-99969 | 6/1985 | Japan . |
| 2-97852 | 4/1990 | Japan . |

*Primary Examiner*—William E. Tapolcai
*Attorney, Agent, or Firm*—Lowe, Price, LeBlanc & Becker

[57] ABSTRACT

An air refrigerant ice forming equipment having formed therein a refrigeration cycle using air as a working medium, said refrigeration cycle comprising a passage for air circulation incorporating an air compressor, a compressed air cooler, an air expander and a heat exchanger for ice formation disposed in the indicated order along the flow of air characterized in that said equipment further comprises a heat exchanger for heat recovery wherein the air before entering the air expander is heat exchanged with the air which has passed through the heat exchanger for ice formation and that said air expander has a rotor caused to rotate by the action of air flowing through said passage for air circulation, a rotating shaft of said rotor is connected via a one-way clutch to a rotating shaft of a motor for driving said air compressor.

9 Claims, 14 Drawing Sheets

AIR REFRIGERANT ICE FORMING EQUIPMENT

This application is a continuation of application Ser. No. 08/428,128 filed as PCT/JP93/00316, Mar. 17, 1993, now abandoned.

FIELD OF APPLICATION IN INDUSTRY

The invention relates to an air refrigerant ice forming equipment in which air is utilized as a working medium. More particularly, it relates to an air refrigerant ice forming equipment suitable for use in facilities for ice sports including bobsleigh, ice skate, ice hockey and other ice sports.

PRIOR ART

In facilities for ice sports including bobsleigh, ice skate, ice hockey and other ice sports, it is necessary to properly and quickly form or supplement ice.

In such facilities for playing ice sports use has heretofore been made of ice forming equipment in which a working medium such as from or ammonia of a refrigeration cycle is evaporated in ice forming coils (evaporators) buried in an ice rink or course of the facilities. Also use has been made of ice forming equipment in which brine made in a refrigerator is circulated through the above-mentioned ice forming coils.

However, with the ice forming equipment mentioned above, leakage of the working medium and/or brine may occur as a result of mal-construction or changes with year of the equipment. Particularly, when strainers are cleaned or replaced at the time of periodical maintenance of the equipment, the leakage of the working medium and/or brine necessarily occurs. It is reported that an amount of the working medium released in one year has been calculated as amounting to 5% of the working medium charged in the equipment Leakage of from poses a problem of destruction of the ozone layers, while leakage of ammonia causes air and soil pollution and leakage of brine causes soil pollution. Accordingly, from the view point of protecting environment, it is of urgent necessity to take a measure for avoidance of the above-mentioned problems.

Also known in the art is a refrigeration cycle in which air is used as a working medium. However, since the efficiency of the air refrigerant refrigeration cycle is generally low, a large driving force or electric power is consumed. Accordingly, running of the air refrigerant refrigeration cycle is rather expensive and less energy saving, and therefore, has not been generally practiced in an ice forming equipment. For example, in a case of forming ice in ambient atmosphere at a temperature of 5° C., an air refrigerant refrigerator in which air is used as a working medium exhibits a coefficient of performance of about 0.8, which value is about ⅓ to ½ of the coefficient of performance of a refrigerator in which from is used as a working medium.

On the other hand, a cogeneration system for comprehensively utilizing heat and power of a heat engine has come into wide use, and on a refrigerator wherein power of a heat engine of a cogeneration system is utilized as a source for driving the refrigerator various technologies have been developed how to achieve the most energy saving result. All refrigerators concerned, however, have been those using from or ammonia as a working medium.

OBJECT OF THE INVENTION

An object of the invention is to effectively form ice in facilities for playing ice sports without using from or ammonia as a working medium and without using brine as a cooling medium.

DISCLOSURE OF THE INVENTION

According to the invention there is provided an air refrigerant ice forming equipment having formed therein a refrigeration cycle using air as a working medium, said refrigeration cycle comprising a passage for air circulation incorporating an air compressor, a compressed air cooler for cooling the air compressed by the compressor with heat transfer media outside the refrigeration cycle, an air expander for expanding the air which has passed through the cooler to provide cold air and a heat exchanger for ice formation using the cold air which has passed the air expander disposed in the indicated order along the flow of air, said passage for air circulation including a return passage for returning the air which has passed through said heat exchanger for ice formation to said air compressor characterized in that said equipment further comprises a heat exchanger for heat recovery wherein the air before entering the air expander is heat exchanged with the air which has passed through the heat exchanger for ice formation before the latter air is returned to the air compressor.

The air refrigerant ice forming equipment according to the invention may have one or more of the following features:

that said air expander has a rotor caused to rotate by the action of air flowing through said passage for air circulation, a rotating shaft of said rotor is coupled via a one-way clutch to a rotating shaft of a power means for driving said air compressor and that the air circulated through the passage for air circulation is dry substantially free from moisture and said equipment is further provided with an exit port for discharging a part of the dry and cold air outside the equipment after the dry and cold air has passed through said air expander either on its way to said heat exchanger for ice formation or while it is passing through said heat exchanger for ice formation and with an inlet port having an air dehumidifier in said return passage for introducing dry air into said passage for air circulation by inhaling atmospheric air.

PREFERRED EMBODIMENT OF THE INVENTION

Figure 1:
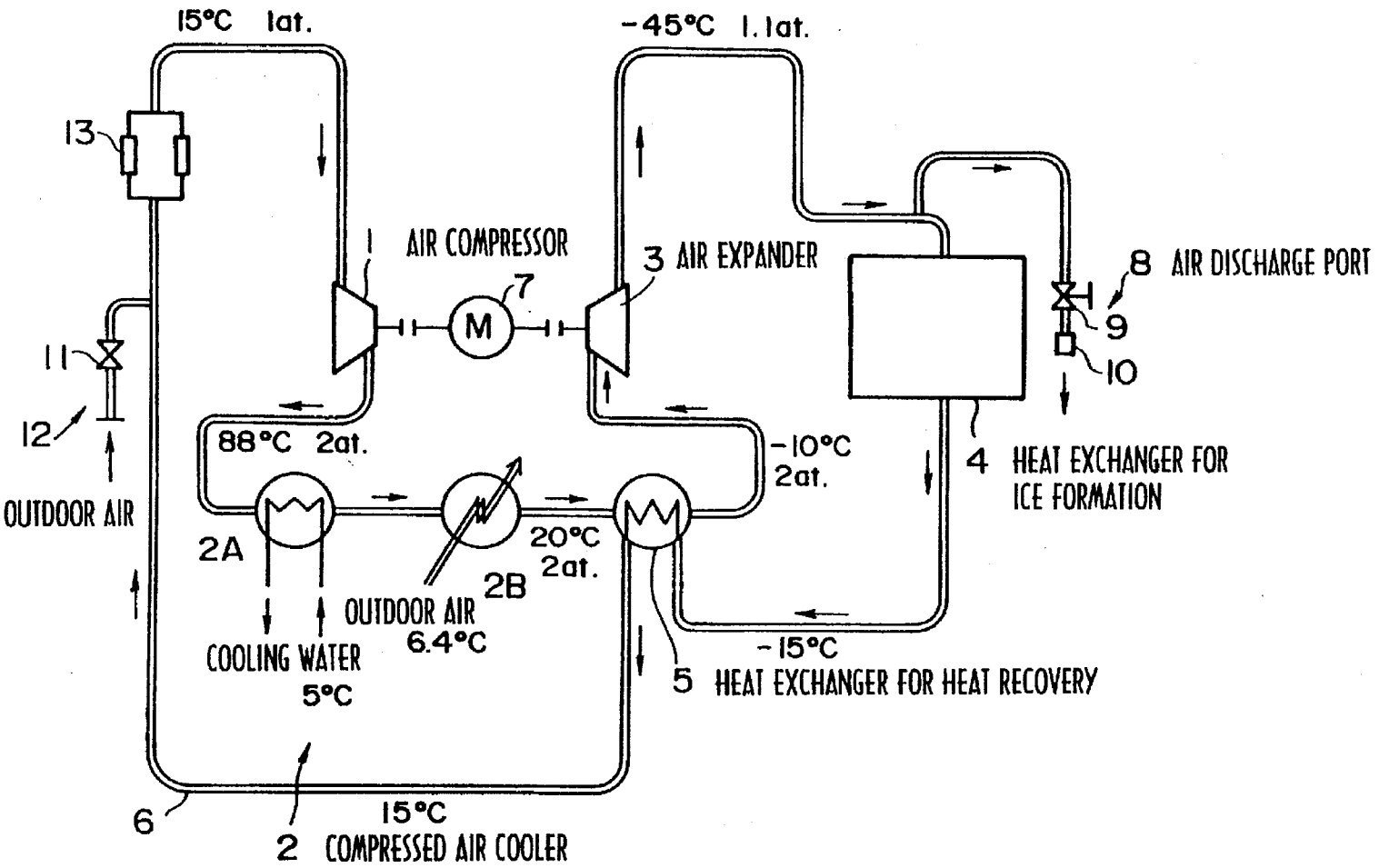
FIG. 1 is a system drawing of an air refrigerant ice forming equipment according to the invention showing an arrangement of various instruments.

FIG. 1 is a system drawing of an air refrigerant ice forming equipment according to the invention showing an arrangement of various instruments and a flow of air. As shown in FIG. 1, the ice forming equipment according to the invention comprises a closed passage for air circulation incorporating an air compressor 1, a compressed air cooler 2 for cooling the air compressed by the compressor 1 with heat transfer media outside the refrigeration cycle, an air expander 3 for expanding the air which has passed through the cooler 2 to provide cold air and a heat exchanger 4 for ice formation using the cold air which has passed the air expander 3, in the indicated order along the flow of air.

The ice forming equipment according to the invention further comprises a heat exchanger 5 for heat recovery wherein the air before entering the air expander 3 is heat exchanged with the air which has passed through the heat exchanger 4 for ice formation. The air whose cold heat has been recovered in the heat exchanger 5, is then returned to the air compressor 1 via a return pipe 6.

Figure 2:
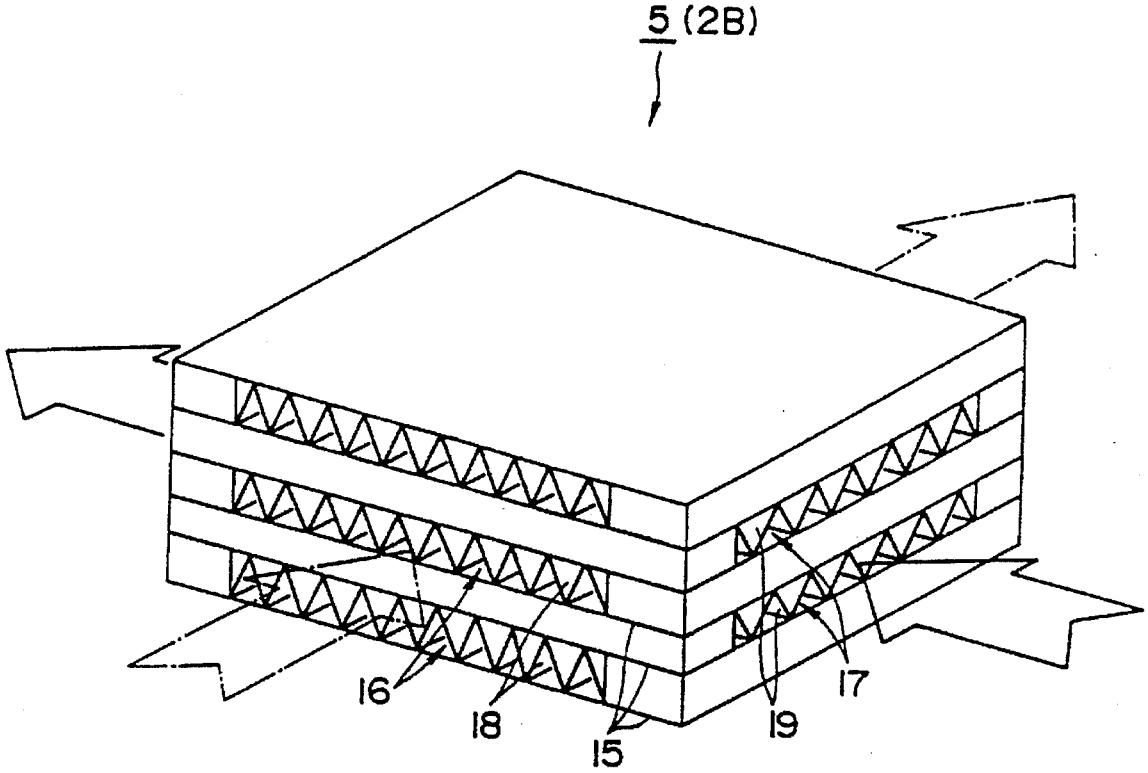
FIG. 2 is a perspective view of an air to air heat exchanger.

The heat exchanger 5 for heat recovery is an air to air heat exchanger as shown in FIG. 2. In the heat exchanger 5, air passages 16 and the other air passages 17 are vertically alternately formed in a plurality of clearances formed by a plurality of plates 15. Each air passage 16 or 17 is divided into a plurality of narrow passages 18 or 19 in order to enhance the effectiveness of the heat exchanger. Through the air passage 16 (or 17) air which has been compressed by the compressor 1 is caused to pass, while through the air passage 17 (or 16) air which has come from the heat exchanger 4 for ice formation is caused to pass. The warm air from the compressor 1 is cooled by heat exchange with the cold air from the heat exchanger 4. Whereas the cold air coming from the heat exchanger 4 for ice formation is warmed and thus, the temperature of air returned to the air compressor 1 via the return pipe 6 is raised. As a result, the coefficient of performance of the refrigeration cycle is enhanced.

The compressed air cooler 2 for cooling the air coming from the compressor 1 comprises two heat exchangers 2A and 2B.

Figure 3:
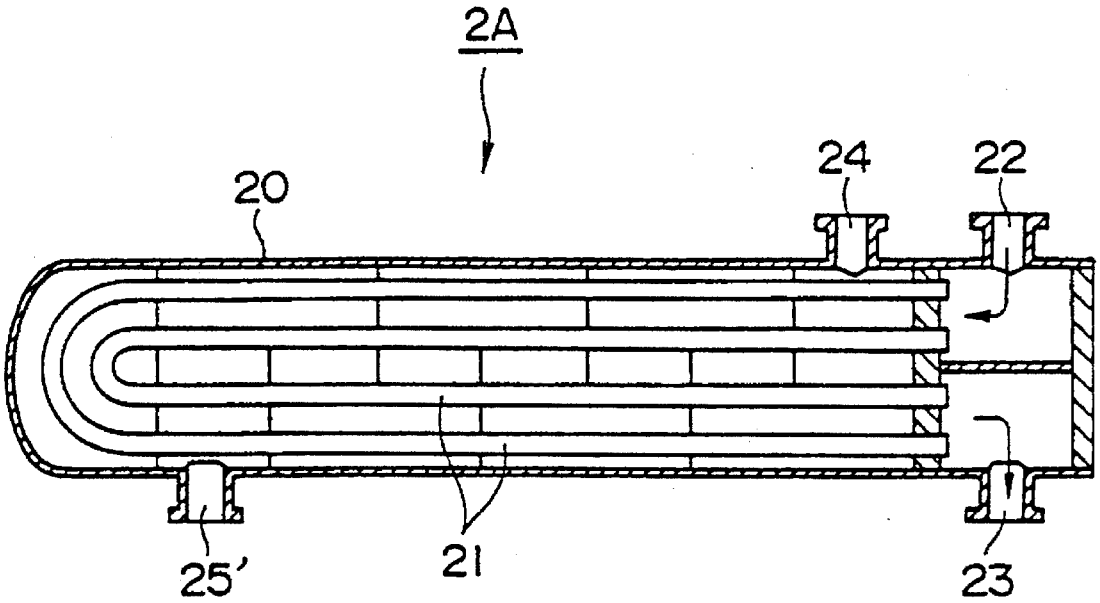
FIG. 3 is a cross-sectional view of a shell and tube heat exchanger.

The heat exchanger 2A can be a shell and tube heat exchanger, as shown in FIG. 3, which comprises a shell 20 and a plurality of U tubes 21 incorporated in the shell 20. The shell 20 is provided with a water inlet 22 and a water outlet 23 at one end thereof. The water inlet 22 is communicated with the water outlet 23 by means of the U tubes 21. The shell 20 is further provided with an air inlet 24 and an air outlet 25'

With the shown shell and tube heat exchanger 2A, cooling water is introduced from the water inlet 22, caused to pass through the U tubes and withdrawn from the water outlet 23. In the winter season normal tap water may used as the cooling water. The compressed air from the compressor 1 is introduced through the air inlet 24 into the inside of the shell 20 and withdrawn from the air outlet 25'. Thus, the compressed air is cooled by heat exchange with the cooling water in the inside of the shell 20.

The heat exchanger 2B is an air to air heat exchanger, which may be of the same type as the heat exchanger 5 for heat recovery shown in FIG. 2. Cooling air usable in the heat exchanger 2B must be of a low temperature. In the winter season ambient atmospheric air can be used as such as the cooling air.

Figure 4:
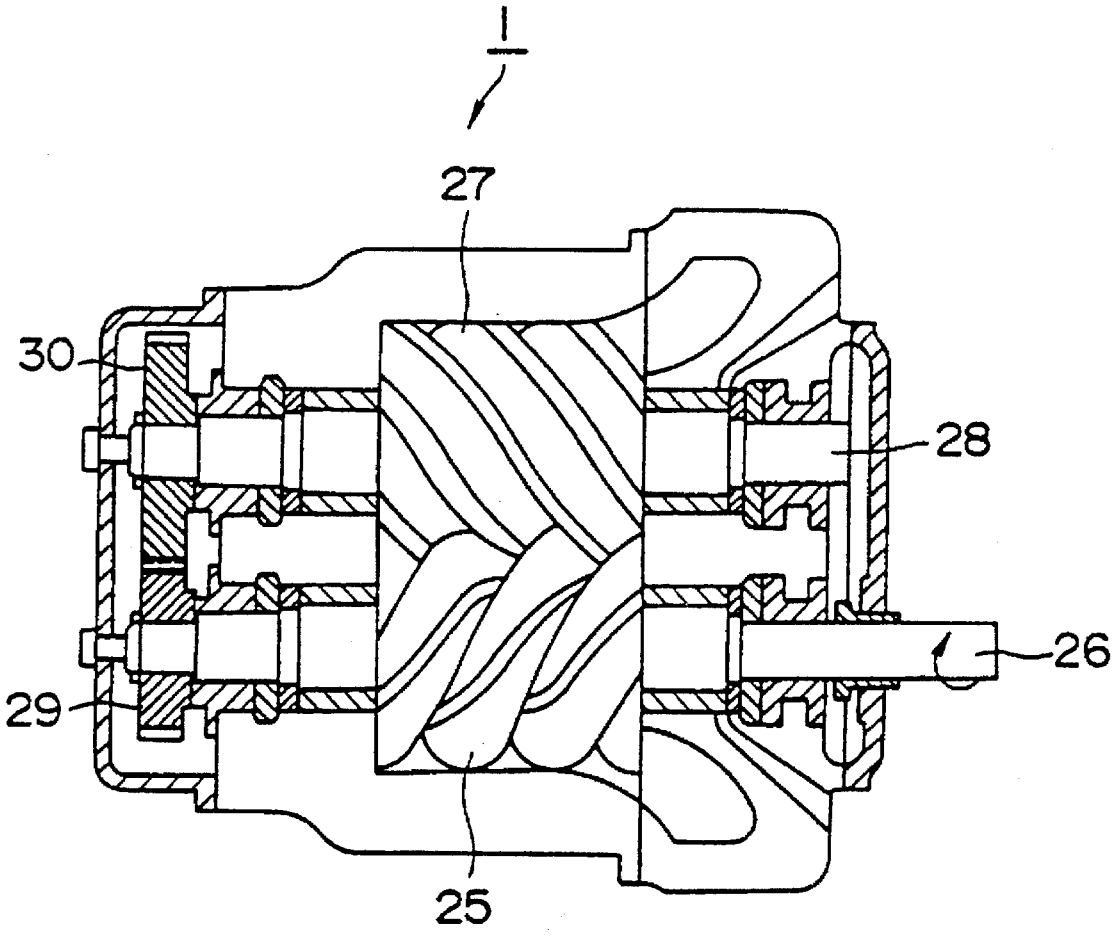
FIG. 4 is a transverse cross-sectional view of an air compressor.
Figure 5:
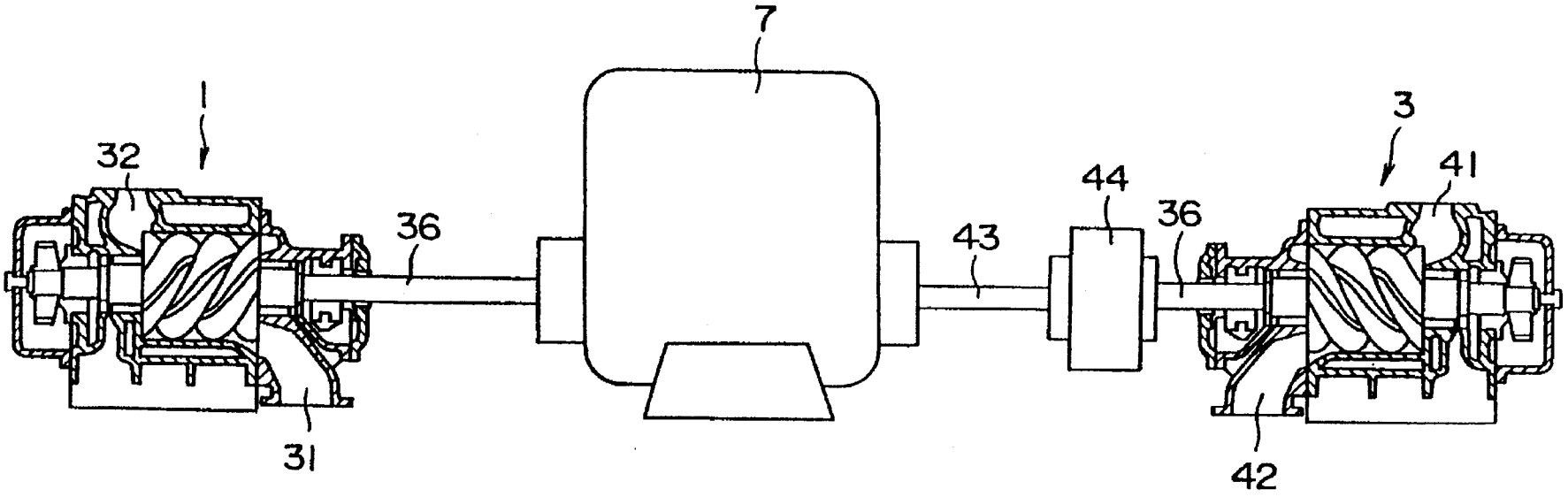
FIG. 5 is a view for showing an arrangement of the air compressor, a motor and an air expander.

The air compressor 1 is for forcibly compressing air of atmospheric pressure by means of a rotating power of a power means 7 to provide compressed air, for example, having a pressure of 2 atmospheres. The air compressor 1 can be a bisexual screw type compressor whose structure in itself is known in the art. The biaxual screw type compressor, as shown in FIGS. 4 and 5, includes a male rotor 25 having screw vanes and a female rotor 27 having screw grooves which engage each other. By rotation of the rotors in the opposite directions air undergoes volume changes in the screw grooves and is compressed. A shaft 26 of the male rotor 25 and a shaft 28 of the female rotor 27 are in gear by means of gears 29 and 30 so that they may rotate in the opposite directions. The rotation of the power means 7 is transmitted to the shaft 26 and the rotors 25 and 27 are caused to rotate in the opposite directions. Air inhaled through a suction inlet 31 is gradually compressed by the rotation of the rotors 25 and 27 to a pressure of about 2 atmospheres and exhaled through an outlet 32. The power means shown in FIG. 5 is a motor.

Figure 6:
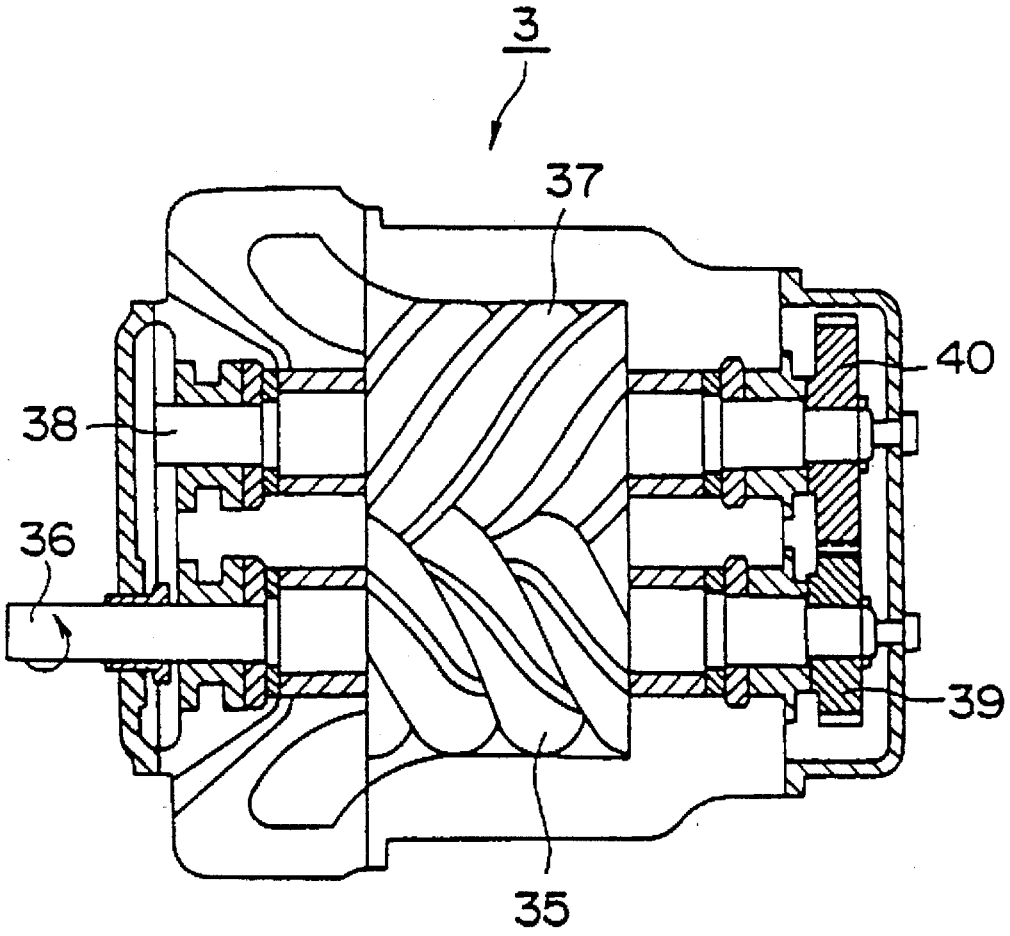
FIG. 6 is a transverse cross-sectional view of an air expander.

The air expander 3 is a biaxual screw type air expander having a structure symmetric to that of the air compressor 1, as shown in FIGS. 5 and 6. A shaft 36 of a male rotor 35 and a shaft 38 of a female rotor 37 are in gear by means of gears 39 and 40 so that they may rotate in the opposite directions. The compressed air introduced into the air expander 3 through an inlet 41 causes the rotors 35 and 37 to rotate by its pressure and air itself is adiabatically expanded to a pressure slightly higher than the atmospheric pressure and its temperature is decreased. The cold air so formed is exhaled through an outlet 42.

The shaft 36 of the male rotor 35 of the air expander 3 is coupled to a driving shaft 43 of the power means 7 via a one-way clutch 44.

Figure 7:
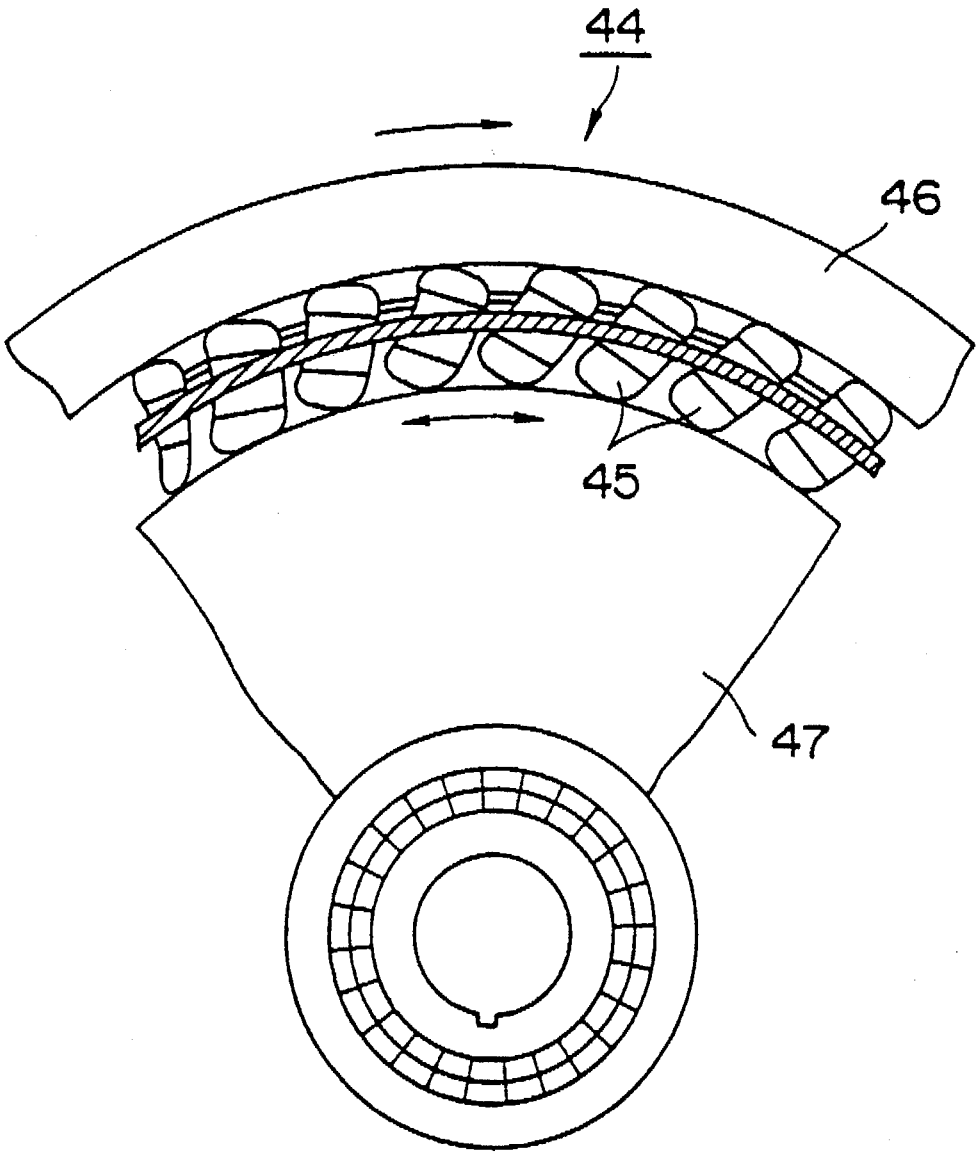
FIG. 7 is an enlarged partial view of a one-way clutch.

The one-way clutch 44 includes, as shown in FIG. 7, an outer ring 46 and an inner ring 47 and a plurality of cams 45 disposed in an annular space between the outer and inner rings 46 and 47. The cams 45 are arranged obliquely against a radial direction common to the outer and inner rings 46 and 47. By this oblique arrangement of the cams 45, rotation can be transmitted one-way between the outer and inner rings. The structure of the one-way clutch 44 itself is well known in the art. By coupling the rotor axis 36 of the air expander 3 with the driving shaft 43 of the motor 7 via the one-way clutch 44, the rotating energy of the rotors 35 and 37 of the air expander 3 can be transmitted to the driving shaft 43 of the motor 7 and recovered as a part of the driving power for the air compressor 1.

Figure 8:
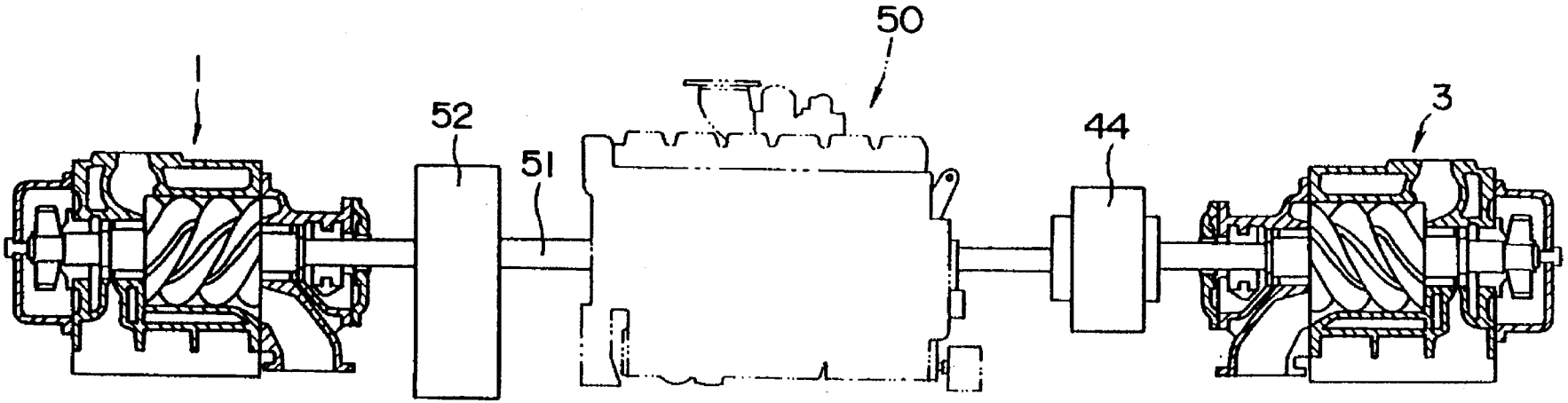
FIG. 8 is a view for showing an arrangement of the air compressor, a heat engine for cogeneration purpose and the air expander.

As shown in FIG. 8, the driving power for the air compressor 1 may be obtained from a heat engine 50 for a cogeneration purpose, that is from a driving shaft 51 of an electric generator 50. When the air compressor 1 is driven by the power of the heat engine 50, the driving shaft 51 of the heat engine 50 is coupled to the driving shaft 26 of the compressor 1 via a variable speed gear 52.

In the heat engine 50, a hot exhaust gas obtained by combustion of fuel is sent to an exhaust gas boiler, from which high pressure steam is obtained. Whereas the used exhaust gas is heat exchanged with cooling water and thereafter exhausted outside the system. Warm water is obtained from the cooling water of the heat engine 50. The power for driving the air compressor 1 is obtained from an exhaust gas turbine of the heat engine 50 for cogeneration purpose.

The surplus power of the heat engine 50 may be used as power for electric generation or as power for driving other power machines. Thus, the rotating power of the heat engine 50 is fully utilized as a whole, primarily for operating the ice forming equipment according to the invention and the remaining for accumulation of electricity or other purposes in accordance with particular conditions for driving the ice forming equipment.

The heat exchanger 4 for ice formation is a heat exchanger for forming ice layers on outer surfaces thereof by passing therethrough cold air which has been formed by the air expander 3.

The heat exchanger 4 for ice formation is buried beneath the ice level, for example of an ice course for bobsleighing or luging or of an ice rink for ice skating or ice hockey, for forming necessary ice layers on the outer surfaces of the heat exchanger 4. The heat exchanger 4 for ice formation may be composed of a plurality of pipes arranged in accordance with the desired particular position and shape of the ice layers. Facilities for ice sports may be provided with the heat exchangers for ice formation in the form of an extended surface coil heat exchanger or in the form of a plane heat exchanger comprising a heat conducting material having a plurality of pipes buried therein.

Figure 9:
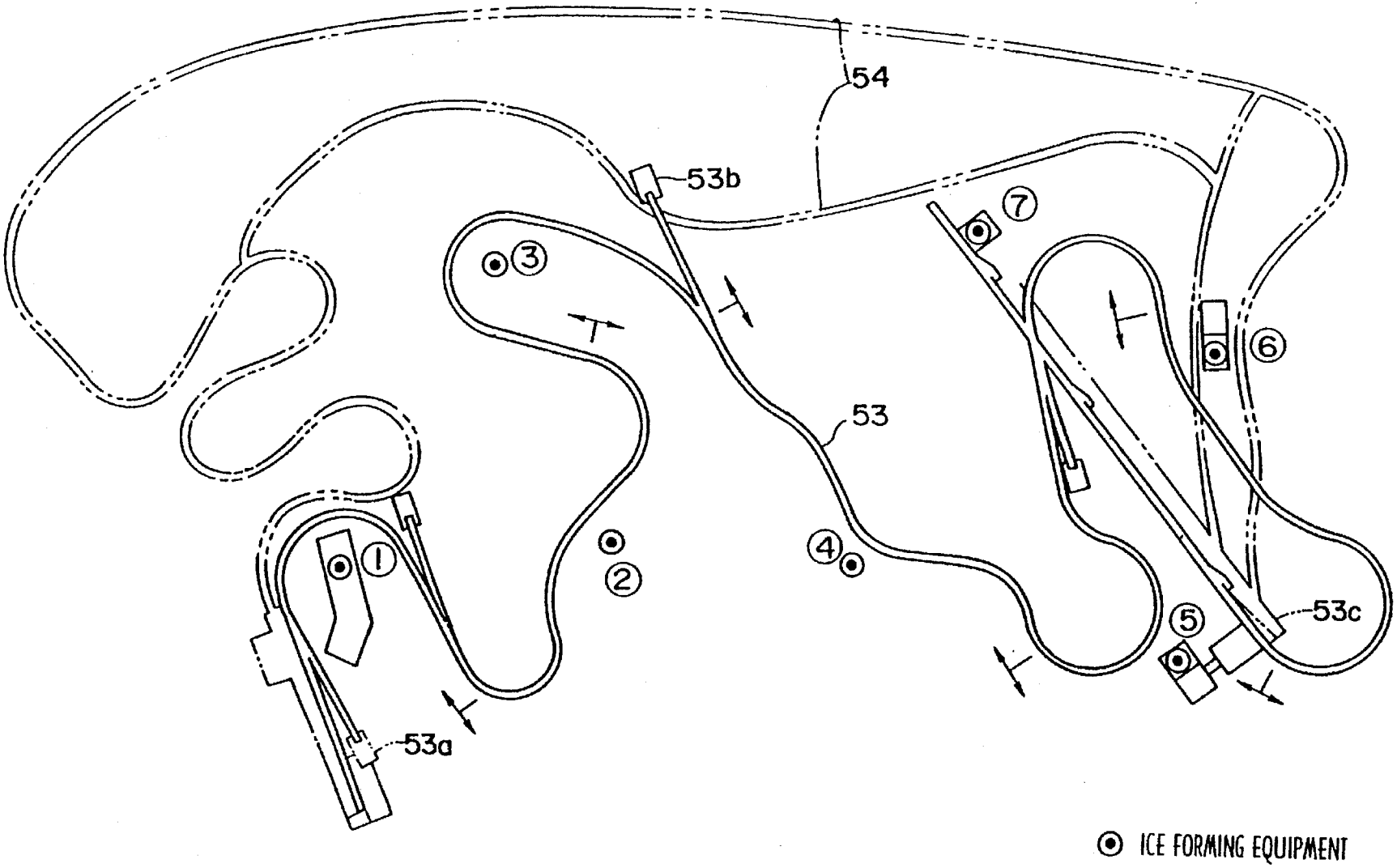
FIG. 9 is a plan view of a bobsleigh or luge course.

FIG. 9 shows a course 53 for bobsleigh or luging. The illustrated course 53 having a length of about 1.3 kilometers is divided into 7 parts 1 to 7, each part having an individually controlled ice forming equipment. In FIG. 9, solid double circles indicate the positions where the ice forming 20 equipment are disposed. Passages for air circulation of the adjacently disposed ice forming equipment are connected to each other by means of a by-path so as to circumvent trouble which may be caused when one of the adjacent equipment gets out of order.

The course 53 begins at a starting point 53*a* and ends at a finish point 53*c*. Slightly downstream of the starting point 53*a* there is provided a starting point 53*b* for junior. Between the starting points 53*a*, 53*b* and the finish point 53*c*, there is provided a passage 54 for carrying back vehicles from the finish point 53*c* to the starting points 53*a*, 53*b*.

Figure 10:
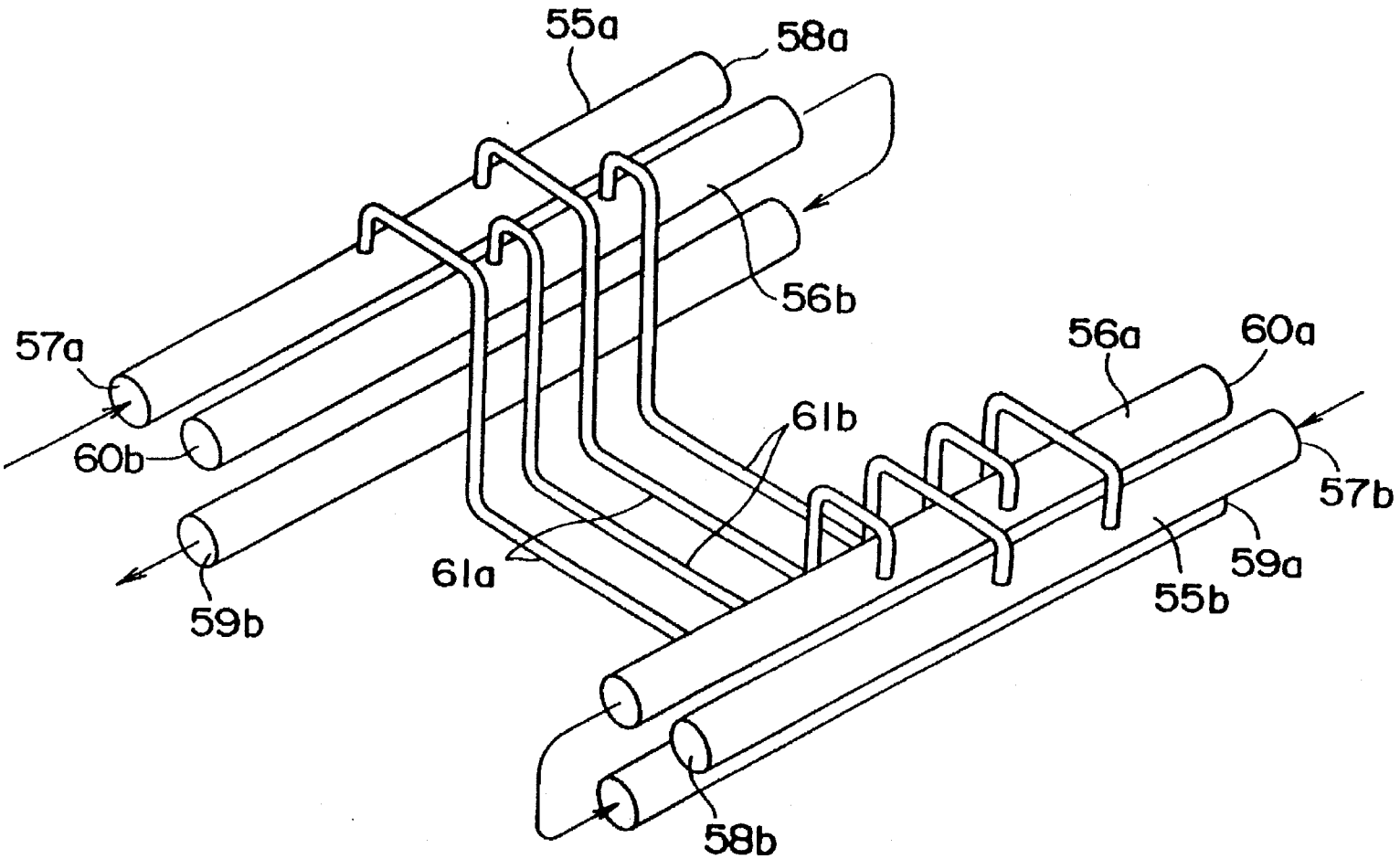
FIG. 10 is a piping layout of a heat exchanger for ice formation.
Figure 11:
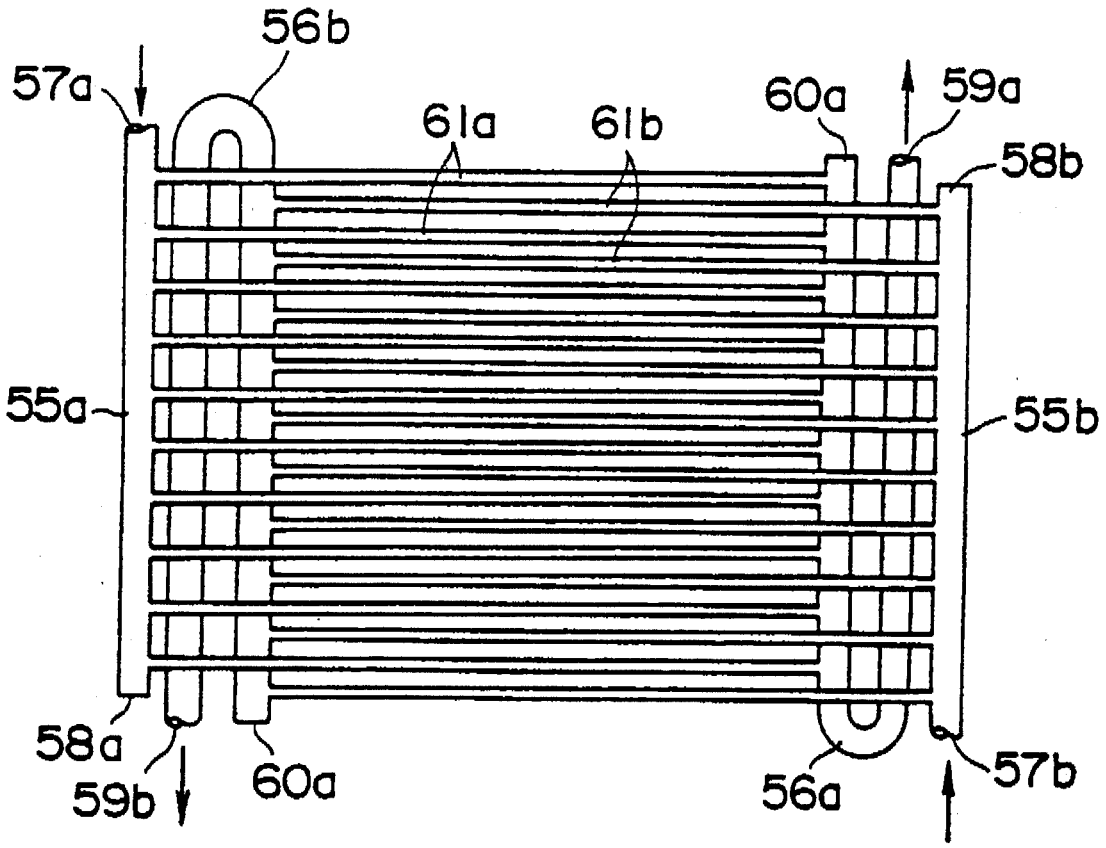
FIG. 11 is a plan view of piping of the heat exchanger for ice formation.

FIG. 10 is a piping layout of a heat exchanger 4 for ice formation buried in the course 53, and FIG. 11 is a plan view of the piping of the heat exchanger 4 for ice formation. On one side of the course there are provided a cold air supply pipe 55*a* and a cold air return pipe 56*b*, while on the other side of the course there are provided a cold air supply pipe 55*b* and a cold air return pipe 56*a*. One end 57*a* of the cold air supply pipe 55*a* is communicated with the air expander, while the other end 58*a* of the cold air supply pipe 55*a* is closed. Likewise, one end 57*b* of the cold air supply pipe 55*b* is communicated with the air expander, while the other end 58*b* of the cold air supply pipe 55*b* is closed. The cold air return pipes 56*a*, 56*b* are U-shaped pipes with one end 59*a*, 59*b* communicated with the heat exchanger for heat recovery and the other end 60*a*, 60*b* closed.

The cold air supply pipe 55*a* on one side of the course 53 makes a pair to the cold air return pipe 56*a* of the other side of the course 53. Likewise, the cold air supply pipe 55*b* on the other side of the course 53 makes a pair to the cold air return pipe 56*b* of one side of the course 53. The cold air supply pipe 55*a* and return pipe 56*a* making a pair to each other are communicated by a plurality of ice forming pipes 61*a* disposed in parallel across the course beneath the level of ice. Likewise, the cold air supply pipe 55*b* and return pipe 56*b* making a pair to each other are communicated by a plurality of ice forming pipes 61*b* disposed in parallel. As shown in FIG. 10, the ice forming pipes 61*a* and 61*b* are arranged alternately.

The cold air prepared in the air expander 3 is divided into two which are respectively introduced into the cold air supply pipes 55*a*, 55*b* through their open ends 57*a*, 57*b*. Since the other ends 58*a*, 58*b* of the supply pipes 55*a*, 55*b* are closed, the cold air supplied is caused to pass through the ice forming pipes 61*a*, 61*b*, recovered in the cold air return pipes 56*a*, 56*b*, combined together and sent into the return passage 6.

Figure 12:
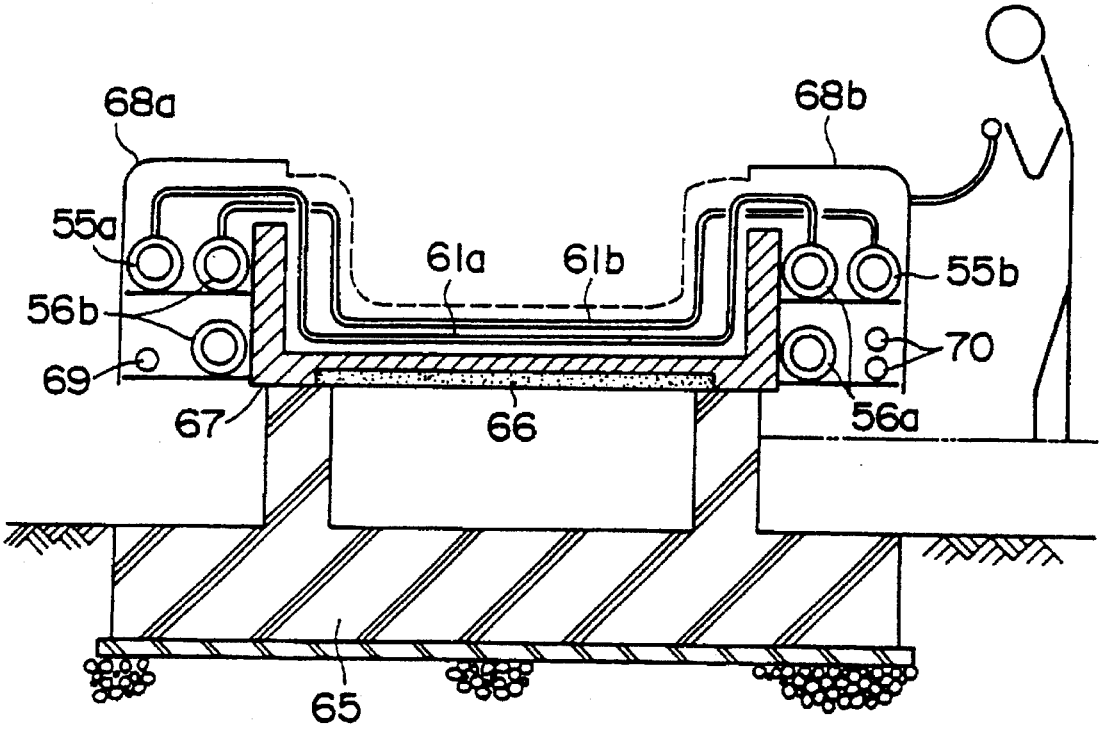
FIG. 12 is a cross-sectional view of a linear portion of the playing course.

FIG. 12 is a cross-sectional view of a linear portion of a course for bobsleighing provided with an ice forming equipment according to the present invention. In FIG. 12, the reference numeral 65 designates a concrete base; 66 a concrete plate; and 67 a heat insulating mortar layer. On both sides of the course side covers 68*a* and 68*b* are respectively provided. Inside the side cover 68*a* there are contained the cold air supply pipe 55*a*, the cold air return pipe 56*b* and a tap water pipe 69. Inside the side cover 68*b* there are contained the cold air supply pipe 55*b*, the cold air return pipe 56*a* and a warm water pipe 70.

On the heat insulating mortar layer 67, a plurality of ice forming pipes 61*a* communicating the cold air supply pipe 55*a* and return pipe 56*a* and a plurality of ice forming pipes 61*b* communicating the cold air supply pipe 55*b* and return pipe 56*b* are alternately disposed in parallel across the course as shown in FIG. 11. Upper surfaces of the ice forming pipes 61*a* and 61*b* are covered by a heat conducting mortar layer via a wire mesh. The heat conducting mortar layer contains metallic powder dispersed therein.

The cold air prepared by the air expander 3 is sent into the cold air supply pipes 55*a*, 55*b* disposed inside the side covers 68*a*, 68*b*. The cold air is then caused to pass through the ice forming pipes 61*a*, 61*b* buried in the course, recovered in the return pipes 56*a*, 56*b*, caused to pass through the heat exchanger 5 for heat recovery and the return passage 6 and returned to the air compressor 1.

If desired, the ice forming equipment according to the invention may be designed so that a part of the cold air prepared by the air expander 3 may be discharged through an air discharge port 8 which comprises a valve or damper 9 and a nozzle 10 (see FIG. 1). By bringing the discharged cold air in contact with water, it is possible to form a desired quantity of ice at an intended place of the course.

In a case wherein a part of the circulated air is discharged outside the refrigeration cycle, an amount of atmospheric air corresponding to the discharged amount of air must be sucked into the refrigeration cycle. For this purpose, a port 12 for sucking atmospheric air provided with a valve or damper 11 is connected to the return passage 6 on its way from the heat exchanger 5 for heat recovery to the air compressor 1, as shown in FIG. 1. By properly operating the valve or damper 11, a necessary amount of atmospheric air can be sucked into the closed passage for air circulation.

In a case wherein atmospheric air is introduced into the refrigeration cycle, a problem arises as to the removal of moisture of the introduced atmospheric air. The problem can be solved by providing an air dehumidifier 13 upstream of the air compressor 1. By means of the air dehumidifier 13, dry air substantially free from moisture can be introduced into the passage for air circulation. As to the air dehumidifier 13, dry dehumidifiers using a hygroscopic agent such as silica gel are conveniently used. Suitable dry dehumidifiers include a Munter's dehumidifier (rotary dehumidifier having a function of reproducing the spent hygroscopic agent) and a two-tower dehumidifier wherein dehumidification of air and reproduction of the spent hygroscopic agent are alternately carried out (FIG. 1 illustrates a two-tower dehumidifier).

Figure 13:
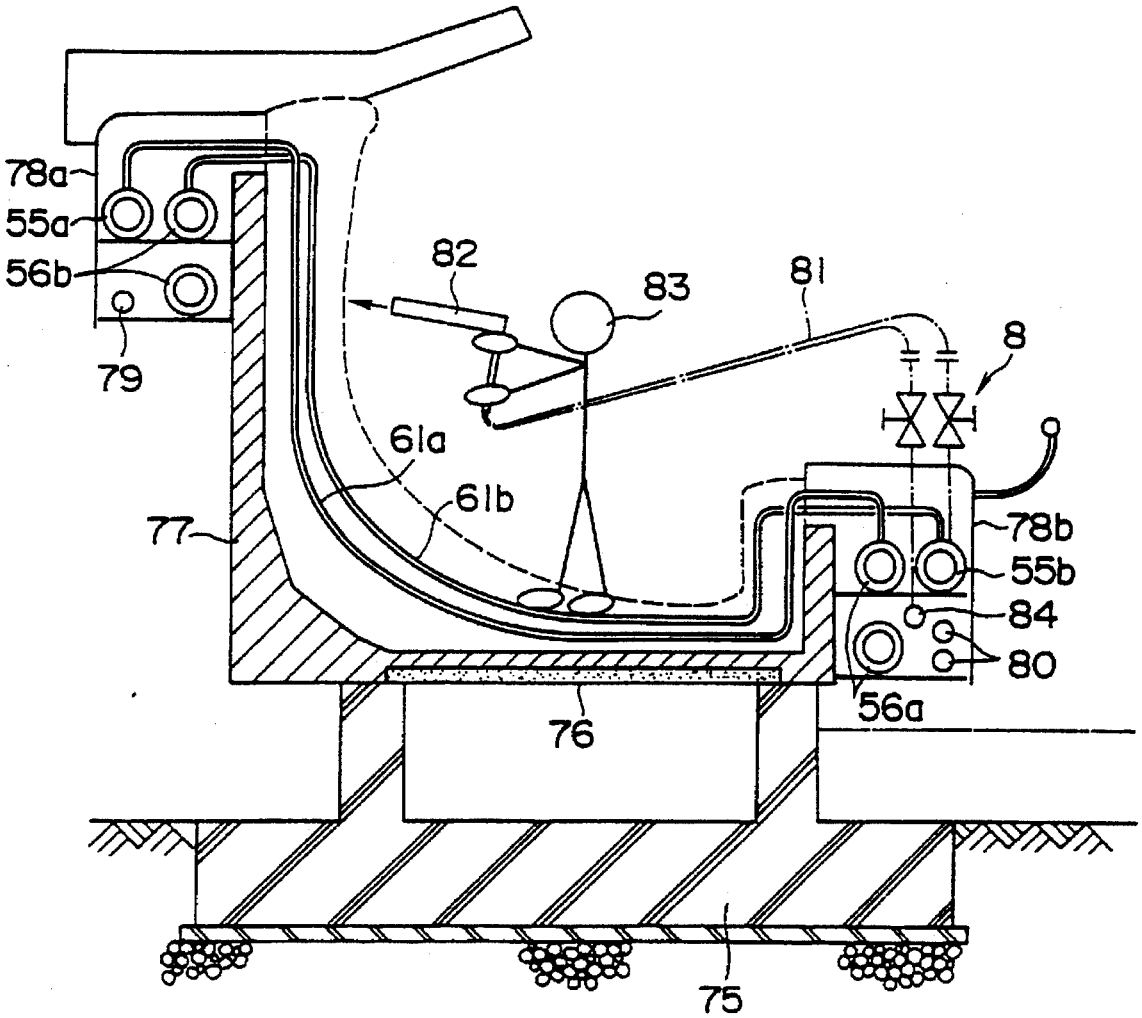
FIG. 13 is a cross-sectional view of a curved portion of the playing course.

FIG. 13 is a cross-sectional view of a curved portion of a course for bobsleighing provided with an ice forming equipment according to the invention. The basic construction of the curved course is substantially the same as that of the linear course shown in FIG. 12. The reference numeral 75 designates concrete base; 76 a concrete plate; and 77 an adiabatic mortar layer. The heat insulating mortar layer 77 has an L-shaped cross-section so as to form a bank. On both sides of the course side covers 78*a* and 78*b* are provided. Inside the side cover 78*a* there are contained the cold air supply pipe 55*a*, the cold air return pipe 56*b* and a tap water pipe 79. Inside the side cover 78*b* there are contained the cold air supply pipe 55*b*, the cold air return pipe 56*a* and a warm water pipe 80. On the heat insulating mortar layer 77, a plurality of ice forming pipes 61a communicating the cold air supply pipe 55*a* and return pipe 56*a* and a plurality of ice forming pipes 61*b* communicating the cold air supply pipe 55*b* and return pipe 56*b* are alternately disposed in parallel across the course.

In the example illustrated in FIG. 13, an air discharge port 8 is provided for discharging cold air from the cold air supply tube 55*b*. To the air discharge port 8 there is connected a nozzle 82 via a flexible tube 81.

Thus, a course keeper 83 can put the course in good condition by injecting a part of the cold air from the cold air supply tube 55*b* through the nozzle 82 via the air discharge port 8 and the flexible tube 81 thereby making up ice at an intended place of the surfaces of the course. The ice making up can be carried out more effectively by injecting the cold air together with an appropriate amount of water taken from the tap water pipe 84 disposed inside the side cover 78*b*. Particularly, in curved portions of the course as shown in FIG. 13 and those portions of the course suffering from solar radiation, the course keeper 83 can skillfully put the course in good condition by utilizing the cold air injected from the nozzle 82. For example, he can spray water taken from the tap water pipe 84, freezing the sprayed water to ice fog and blowing the ice fog against a portion of the course where ice must be supplemented. Alternatively, he can form a film of water on a portion of the course where ice must be supplemented and freezing the film of water by blowing the cold air from the nozzle 82 against the film of water. Furthermore, by mixing cold air taken from the cold air supply pipe 55*b* with water taken from the tap water pipe 84 and blowing the mixture against a portion of the course where ice must be supplemented, an ice layer containing an appropriate amount of air which is best suitable for bobsleighing or luging may be formed on a surface of the course.

Warm water taken from the warm water pipe 80 may be utilized to melt ice on an intended portion of the course and to melt snow on an intended portion of the facility. For example, snow fallen and accumulated on the passage 54 of FIG. 9 may be melted away by the warm water so that a truck may readily run on the passage to transport vehicles from the finish point to the start point.

Figure 14:
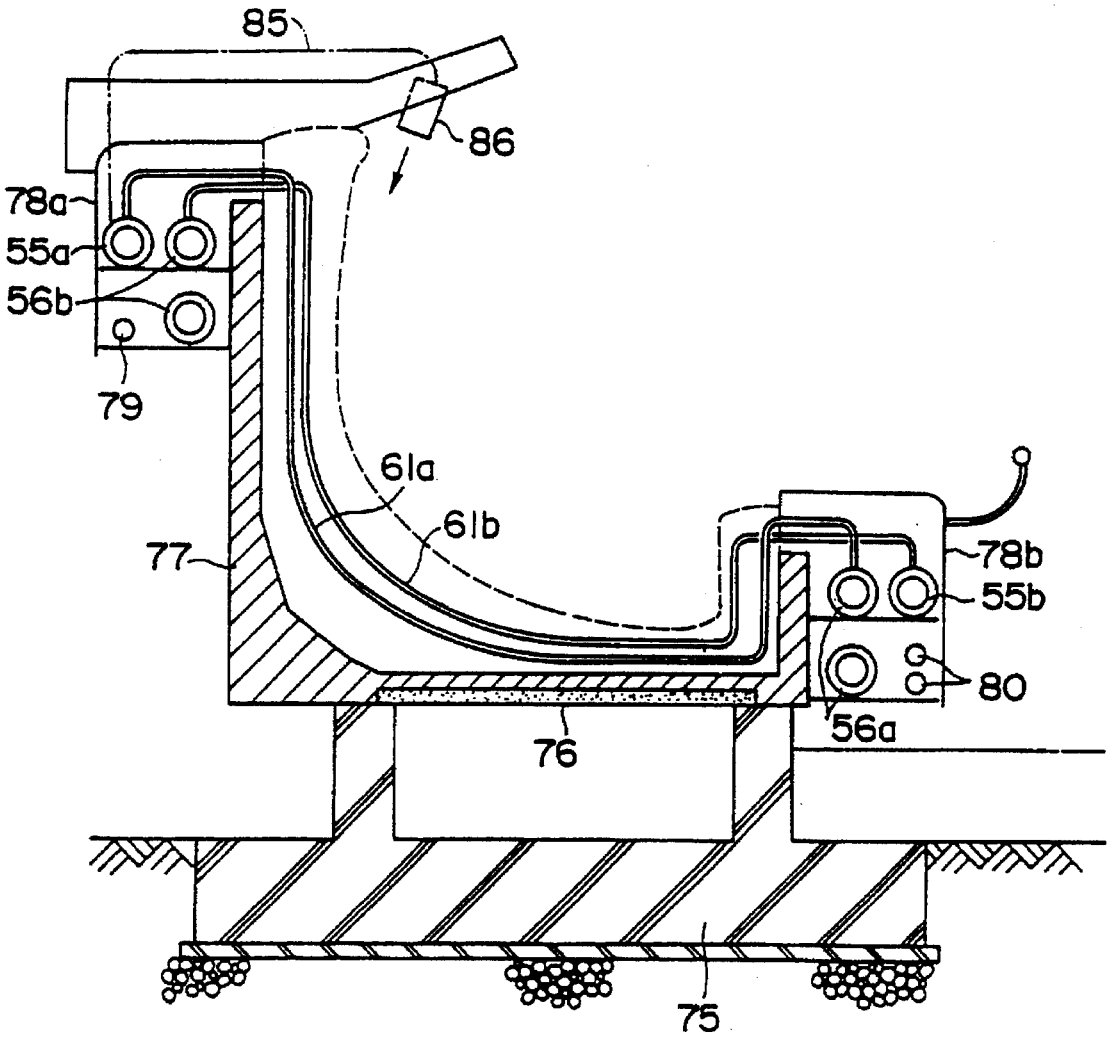
FIG. 14 is a cross-sectional view of a curved portion of the course provided with a cold air injector.

Since a course for playing bobsleigh or luge is snaky in various directions, the required cooling capacity greatly differs from portion to portion. Depending upon the direction and position, sunny or windy portions require a higher cooling capacity than other portions. For portions of the course requiring a high cooling capacity, it is advantageous to take out cold air from the cold air pipe 55*a* and by means of a duct 85 and to inject the cold air through an injector 86 against the surface of the course, as shown in FIG. 14. Such cold air injectors 86 are appropriately provided at portions of the course where increase cooling capacities are required. FIG. 14 is the same as FIG. 13 except that the cold air injector 86 is substituted for the nozzle 82 of FIG. 13. In FIGS. 13 and 14, the same reference numerals designate the same parts.

Various dimensions of an ice forming equipment according to the invention in carrying out ice formation in winter in a facility for playing ice sports can be as follows:

Area for ice formation in a facility:
4500 $m^2$,
Maximum load for ice formation of the facility:
350 kcal/hr.$m^2$,
Average load for ice formation of the facility:
150 kcal/hr.$m^2$,
Necessary rate of flow of air:
3000 $m^3$/min.,
District and period of operation:
3 months from December to February in Japan,
Average temperature of tap water:
5° C., and
Average temperature of atmospheric air:
6.4° C.

Under the conditions as noted above, the temperature of cold air supplied to the heat exchanger 4 for ice formation and the temperature of the air leaving the heat exchanger 4 for ice formation are set −45° C. and −15° C., respectively and the surface of the ice formed is maintained at a temperature from −1° C. to −3° C. For this purpose the air refrigerant ice forming equipment may be operated under the following conditions as shown in FIG. 1.

The air compressor 1 is operated to provide a compressed air having a temperature of 88° C. and a pressure of 2 atmospheres. In the heat exchanger 2A, tap water having a temperature of 5° C. is caused pass and warmed to a temperature of the order of 60° C. In the heat exchanger 2B, atmospheric air having a temperature of 6.4° C. is caused pass and warmed to a temperature of the order of 40° C. By the heat exchange in the heat exchangers 2A and 2B the compressed air is cooled to a temperature of about 20° C. The warm water and air obtained in the heat exchangers 2A and 2B may be utilized for purposes of heating or keeping warmth in the facility. The air expander 3 provides cold air having a temperature of −45° C. and a pressure slightly higher than the atmospheric pressure (for example 1.1 atmospheres) while recovering the power of the air compressor 1. The cold air is sent to the heat exchanger 4 for ice formation and utilized for forming ice under the conditions described above. Air having a temperature of −15° C. which has left the heat exchanger 4 for ice formation is sent to the heat exchanger 5 for heat recovery where it is warmed to a temperature of 15° C. and thereafter returned to the air compressor 1.

Thus, there is formed a refrigeration cycle having a refrigeration capacity of 7.32 kcal/kg of dry air and a coefficient of performance of 0.8. The obtained warm product (warm water and warm air) has a heat quantity of 16.43 kcal/kg with a coefficient of performance of 1.8. Thus, the overall coefficient of performance of the refrigeration cycle is 2.6.

When a driving power for the air compressor 1 is obtained from the driving shaft 51 of the heat engine 50 for a cogeneration purpose, as shown in FIG. 8, letting the energy of fuel supplied to the heat engine be 1, in a case of a heat engine wherein the output of the driving shaft of the heat engine is 0.35 and the heat quantity recovered by the steam and warm water formed by the heat engine is 0.45, since the ice forming equipment provides a refrigeration capacity of 0.28 and heat recovery of 0.63, the total heat quantity obtained by both the cogeneration system and the ice forming apparatus is $$0.45+0.28+0.63=1.36.$$

This value of heat quantity is well comparable with the overall efficiency of a prior art engine driven heat pump using from as a working medium which overall efficiency is $$0.35\times3.0+0.45=1.50$$

wherein 3.0 is a coefficient of performance of the heat pump. This high value of heat quantity has not heretofore been achieved by an air refrigerant ice forming apparatus using air as a working medium, and is higher than a coefficient of performance in terms of a primary energy of a prior art electric refrigerator using from as a working medium whose coefficient of performance is $$0.35\times3.0=1.05$$

wherein 0.35 is an efficiency of a terminal in receiving a commercial electric power.

When a driving power for the air compressor 1 is obtained from an exhaust gas turbine of the heat engine 50 for cogeneration purpose, all the shaft output of the heat engine 50 can be transmitted to the generator for cogeneration purpose. Furthermore, the shaft output of the heat engine 50 may be utilized as a power source for transporting passengers and goods in the facility. In this case if an exhaust gas of the heat engine has a temperature of 580° C. and a pressure of 2 atmospheres, an exhaust gas leaving the turbine has a temperature of 430° C. and a pressure of 1 atmosphere, and an exhaust gas leaving the turbine has a temperature of 250° C. and a pressure of 1 atmosphere, letting the energy of the supplied fuel be 1, there will be realized an output of the shaft of about 0.25, an output of the exhaust gas turbine of about 0.1 and a heat quantity recovered in the steam and warm water of about 0.32.

Accordingly, when the driving power for the air compressor 1 is obtained from an exhaust gas turbine of the heat engine 50 for cogeneration purpose, since the refrigeration cycle according to the invention provides a refrigeration capacity of 0.08 and a quantity of recovered warm heat of 0.18, there will be obtained a driving power of 0.25 and a quantity of heat of $$0.32+0.08+0.18=0.58.$$

These results are comparable to values of the driving power and quantity of heat which have been achieved by an existing cogeneration system wherein a heat engine for cogeneration is combined with a refrigerator using from or ammonia as a working medium. Thus, according to the present invention, in spite of the fact that air is used as a working medium in the refrigeration cycle concerned, there can be constructed an energy saving system highly efficient in recovering cold heat, warm heat and power.

From the heat exchangers 2A and 2B of FIG. 1 warm water and warm air are obtained. Piping can be arranged so that the warm water and air may be transferred to audience seats to keep warmth. The warm water pipe 70 of FIG. 12 and the warm water pipe 80 of FIG. 13 are connected to piping arranged so that warm heat may be supplied close to feet of audience and concerned people who are standing near the course. The warm water taken from the pipes 70 and 80 may be further utilized to melt ice at the time of repairing the course.

Furthermore, by installation of a warm air duct for sending the warm air to a temporary stand for an audience or walking roads in the facility, the environment in the facility may be kept comfortable even in the severe winter season. The warm water may be further utilized to melt snow in the passage 54 of FIG. 9, thereby facilitating the transportation of vehicles from the finish point **53*c* to the starting points 53*a*, 53*b***.

The specific example described hereinabove relates to an application of the invention to a facility for playing ice sports includes a course for bobsleighing or luging which are performed outdoors. The invention is also applicable to a facility (ice rink) for ice skating or ice hockey which are performed indoors. In the latter case, the heat exchanger 4 for ice formation may be constructed in various variations. For example, in order to strengthen the cold air pipe or to enhance its thermal conductivity, it may be buried in the heat conducting mortar, it may be constructed in the form of a finned coil, or it may be formed in the form of a panel-type heat exchanger.

Furthermore, by composing the ice forming pipes of the heat exchanger 4 for ice formation of a first group of ice forming pipes **61*a* communicating the cold air supply pipe 55*a* and the cold air return pipe 56*a* and a second group of ice forming pipes 61*b* communicating the cold air supply pipe 55*b* and cold air return pipe 56*b* and alternately arranging the first and second groups of ice forming pipes 61*a* and 61*b* in parallel across the course, as shown in FIGS. 10 and 11**, all ice surfaces of the ice rink or course of the facilities for playing ice sports can be uniformly cooled.

Thus, the refrigeration cycle according to the invention exhibits an excellent coefficient of performance due to recovery of heat and power as described herein, in spite of the fact that air is used as a working medium. Since cold heat necessary for ice formation is obtained using air as a working medium, the ice forming equipment according to the invention is completely free from the problem of environmental pollution. To the contrary, a part of the cold air acting as a working medium can be discharged outside for a purpose of ice formation. In this case ice surfaces of an intended configuration can be readily formed. In addition, since the heat of compression of the air compressor used in making cold air can be recovered in the form of warm air and water which are in turn utilized for forming a warm environment, the power energy for operating the refrigeration cycle can be effectively recovered. Construction of the equipment according to the invention in a particular facility for playing ice sports is simple and easy, since it only requires arrangement of piping for air and water. The ice forming equipment constructed in a certain facility can be easily repaired. Furthermore, if the refrigeration cycle according to the invention is combined with a heat engine for cogeneration purpose, comprehensive energy saving can be achieved, whereby burden of high running cost, which is a defect of existing air refrigerant ice forming equipments, can be greatly reduced.

We claim:

1. An air refrigerant ice forming equipment having formed therein a refrigeration cycle using air as a working medium, said refrigeration cycle comprising a passage for air circulation incorporating an air compressor, a compressed air cooler for cooling the air compressed by the compressor with heat transfer media outside the refrigeration cycle, an air expander for expanding the air which has passed through the cooler to provide cold air and a heat exchanger for ice formation using the cold air which has passed the air expander disposed in the indicated order along the flow of air, said passage for air circulation including a return passage for returning the air which has passed through said heat exchanger for ice formation to said air compressor characterized in that said equipment further comprising a heat exchanger for heat recovery wherein the air before entering the air expander is heat exchanged with the air which has passed through the heat exchanger for ice formation before the latter air is returned to the air compressor, and that said equipment is further provided with an exit port for discharging a part of the cold air outside the equipment after the cold air has passed through said air expander either on its way to said heat exchanger for ice formation or while it is passing through said heat exchanger for ice formation and with an inlet port in said return passage.

2. The air refrigerant ice forming equipment in accordance with claim 1, wherein the heat exchanger for ice formation comprises a plurality of ice forming pipes buried beneath the level of ice of a facility for playing ice sports.

3. The air refrigerant ice forming equipment in accordance with claim 2 wherein the facility for playing ice sports includes a course for playing bobsleigh or luge and the heat exchanger for forming ice comprises a cold air supply pipe disposed along and in one side of the course, a cold air return pipe disposed along and in the other side of the course and a plurality of ice forming pipes communicating the cold air supply and return pipes arranged in parallel across the course.

4. The air refrigerant ice forming equipment in accordance with claim 3 wherein the heat exchanger for forming ice comprises a first cold air supply pipe disposed along and in one side of the course, a first cold air return pipe disposed along and in the other side of the course, a second cold air supply pipe disposed along and in other side of the course, a second cold air return pipe disposed along and in one side of the course, a first group of ice forming pipes arranged in parallel across the course and communicating the first cold air supply and return pipes and a second group of ice forming pipes arranged in parallel across the course and communicating the second cold air supply and return pipes, said first and second groups of ice forming pipes being alternately arranged.

5. The air refrigerant ice forming equipment in accordance with claim 1, wherein a power for driving the air compressor is obtained from an output shaft of a heat engine for cogeneration.

6. The air refrigerant ice forming equipment in accordance with claim 1, wherein a power for driving the air compressor is obtained from an exhaust turbine of a heat engine for cogeneration.

7. An air refrigerant ice forming equipment having formed therein a refrigeration cycle using air as a working medium, said refrigeration cycle comprising a passage for air circulation incorporating an air compressor, a compressed air cooler for cooling the air compressed by the compressor with heat transfer media outside the refrigeration cycle, an air expander for expanding the air which has passed through the cooler to provide cold air and a heat exchanger for ice formation using the cold air which has passed the air expander disposed in the indicated order along the flow of air, said passage for air circulation including a return passage for returning the air which has passed through said heat exchanger for ice formation to said air compressor characterized in that said equipment further comprising a heat exchanger for heat recovery wherein the air before entering the air expander is heat exchanged with the air which has passed through the heat exchanger for ice formation before the latter air is returned to the air compressor, that said air expander has a rotor caused to rotate by the action of air flowing through said passage for air circulation, a rotating shaft of said rotor being coupled via a one-way clutch to a rotating shaft of a power means for driving said air compressor and that the air circulated through the passage for air circulation is dry substantially free from moisture and said equipment is further provided with an exit port for discharging a part of the dry and cold air outside the equipment after the dry and cold air has passed through said air expander either on its way to said heat exchanger for ice formation or while it is passing through said heat exchanger for ice formation and with an inlet port having an air dehumidifier in said return passage for introducing dry air into said passage for air circulation by inhaling atmospheric air.

8. The air refrigerant ice forming equipment in accordance with claim 7 wherein the exit port for discharging air is provided with a nozzle via a flexible tube.

9. The air refrigerant ice forming equipment in accordance with claim 7 wherein the exit port for discharging air is for injecting the dry and cold air in the passage for air circulation against a surface of ice for playing ice sports.

* * * * *